US006145628A

United States Patent [19]

Tanaka

[11] Patent Number: 6,145,628

[45] Date of Patent: Nov. 14, 2000

[54] FOOD AND DRINK CONVEYING SYSTEM

[75] Inventor: Kunihiko Tanaka, Sakai, Japan

[73] Assignee: Kura Corporation Ltd., Osaka, Japan

[21] Appl. No.: 09/246,913

[22] Filed: Feb. 9, 1999

[30] Foreign Application Priority Data

Feb. 13, 1998 [JP] Japan ..... 10-031538
Dec. 9, 1998 [JP] Japan ..... 10-350201

[51] Int. Cl.[7] ..... E04H 3/04
[52] U.S. Cl. ..... 186/50
[58] Field of Search ..... 186/49, 50

[56] References Cited

U.S. PATENT DOCUMENTS

| | | | |
|---|---|---|---|
| 1,147,831 | 7/1915 | Vary et al. | 186/50 |
| 1,382,354 | 6/1921 | Greenberg | 186/49 |
| 2,516,985 | 8/1950 | Hecht | 186/49 X |
| 2,674,203 | 4/1954 | Bellah et al. | 186/50 X |
| 3,575,265 | 4/1971 | Simjian | 186/49 |

FOREIGN PATENT DOCUMENTS

| | | |
|---|---|---|
| 62-164416 | 7/1987 | Japan . |
| 01170418A | 7/1989 | Japan . |
| 5-245033 | 9/1993 | Japan . |

*Primary Examiner*—F. J. Bartuska
*Attorney, Agent, or Firm*—Frishauf, Holtz, Goodman, Langer & Chick, P.C.

[57] ABSTRACT

A food and drink conveying system includes a conveying path for circulating a plurality of containers each having food and drink, and a plurality of tables arranged along the conveying path. The food and drink conveying system also includes a conveying container which holds one of the containers and which is placed on the conveying path, and noticing devices for letting an orderer know an arrival of his/her order proximate the orderer's table, so that the order can reliably be received by the customer, without any fear of the order being taken away on the way to the order's table by another person.

6 Claims, 11 Drawing Sheets

FOOD AND DRINK CONVEYING SYSTEM

BACKGROUND OF THE INVENTION

1. Field of the Invention

The present invention relates to a food and drink conveying system which in an eating house, particularly in a sushi bar, makes a circulation of e.g. dished-up sushi by means of a conveying path so that customers can take the circulating foods and drinks at their own choice.

2. Description of the Prior Art

There are eating houses, such as sushi bars, adopting a food and drink conveying system having a conveying path which circulates along lots of tables or a counter set in the eating house or sushi bar. Foods (e.g. sushi) and drinks dished up on plates are served to the conveying path as occasion calls so that customers at the tables can take and eat a variety of foods and drinks passing in order through the conveying path at their own choice.

Incidentally, in this food and drink conveying system, the foods and drinks dished up on the plates are usually served to the conveying path as occasion calls, irrespective of the customers' liking, but sometimes are served to meet the customers' orders.

When ordering, the customer must watch the conveyance of his/her order and sometimes overlooks his/her order passing past him/her, in the case of which the orderer must wait until his/her order is re-circulated through the conveying path before him/her and, what is worse, another person sometimes may take his/her order away without knowing it before reaching him/her.

SUMMARY OF THE INVENTION

In consideration of this circumstance, the present invention has been developed. It is the object of the invention to provide a food and drink conveying system which enables a food or drink ordered, served to and conveyed through a conveying path to surely be received by the orderer, without any fear of the ordered food or drink being taken out on the way to the orderer's place by another person by mistake.

To achieve the object above, the present invention provides a food and drink conveying system comprising a conveying path for making a circulation of a plurality of containers each containing therein food or drink; a plurality of tables arranged along the conveying path; a conveying container which contains therein the container placing thereon the asordered food or drink and is placed on the conveying path; and noticing means for giving an orderer a notice of an arrival of his/her order contained in the conveying container at a place near the orderer's table.

The noticing means may be formed by a speaker provided either in the conveying container or at the table side, so that the arrival of the order can be announced by means of it.

Additionally or alternatively, the noticing means may be formed by a lamp provided in the conveying container to give the orderer a notice of the arrival of his/her order by lightening or flashing the lamp on and off when the order comes near the orderer's table.

The conveying container is provided with an input portion to which a designated table's mark is input and operation control means for controlling operation of the noticing means by an input by means of the input portion.

The conveying container may have a retracting portion in which the container is kept retracted until a notice by means of the noticing means is started and from which the container is exposed to be taken out when the notice by means of the noticing means is started.

Further, it is preferable that the operation control means is provided with a timer facility in which traveling time for the conveying container to travel to the individual tables is preset and the conveying path is provided with a timer start gate portion for letting the timer of the timer facility start so that at a point in time when a conveying container placed on the conveying path passes the timer start gate portion, the timer of the timer facility can be started.

DETAILED DESCRIPTION OF THE EMBODIMENTS

Referring now to the accompanying drawings, examples of the preferred embodiments of the present invention directed to a food and drink conveying system will be described below. It is to be understood, however, that the scope of the invention is by no means limited to the illustrated embodiments.

Figure 1:
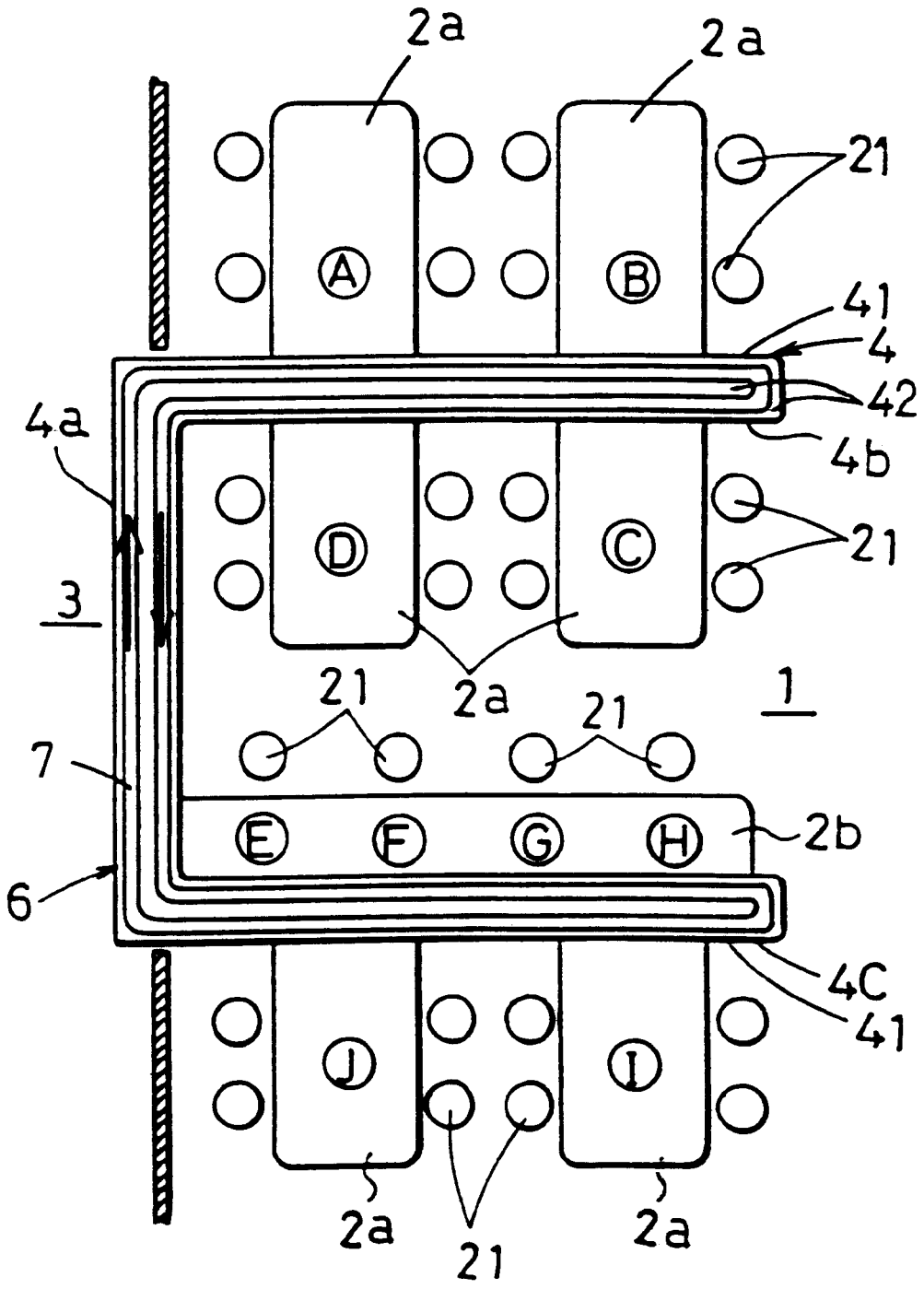
FIG. 1 is a schematic plan view of an interior of an eating house in which a food and drink conveying system of the invention is set.

FIG. 1 shows an interior of a sushi bar as viewed from top in which there are provided a plurality of tables 2*a* and a counter 2*b* set in a dinning area 1; a compartment housing 4 arranged along a front side of a kitchen 3 and the tables and counter 2*a*, 2*b*; and a food and drink conveying system 6 having a conveying path 7, circularly arranged on the compartment housing 4, for circularly conveying foods, such as sushi R, and drinks dished up on plates 5 in the kitchen 3.

The compartment housing 4 having a box shape in section is formed by spaced apart, opposite, side walls 41, a top wall 42, and a bottom wall (not shown) connecting between the both side walls 41 at upper and lower ends thereof.

The compartment housing 4 comprises a first housing portion 4*a*, arranged along the front side of the kitchen 3, for separating the kitchen 3 from the dinning area 1; second and third housing portions 4*b*, 4*c* bending from both lengthwise ends of the first housing portion 4*a* and extending in parallel into the dinning area 1. The tables 2*a* and the counter 2*b* are arranged alongside the side walls 41 at the second and third housing portions 4*b*, 4*c*, and chairs 21 are arranged at the tables and the counter 2*a*, 2*b*.

The tables 2*a* and the counter 2*b* are marked with (A), (B), (C), (D), (E), (F), (G), (H), (I) and (J), as shown in FIG. 1. The counter 2*b* is marked in association with the individual chairs 21, as illustrated. Hereinafter, the table and counter 2*a*, 2*b* sometimes are simply referred to as the table.

Figure 2:
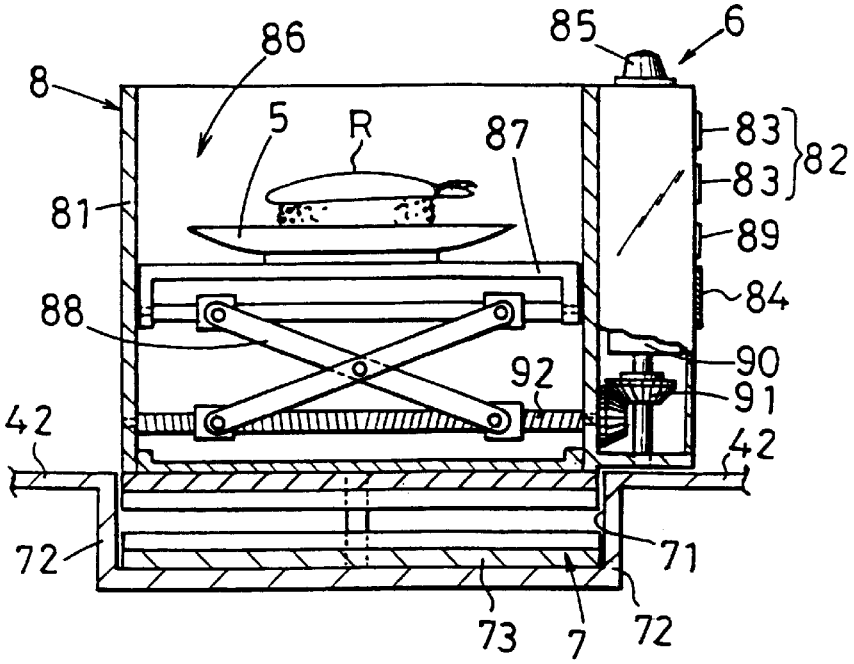
FIG. 2 is a sectional view of a conveying container placed on a conveying path of the food and drink conveying system, with a plate retracted in a retracting portion of the conveying container.
Figure 3:
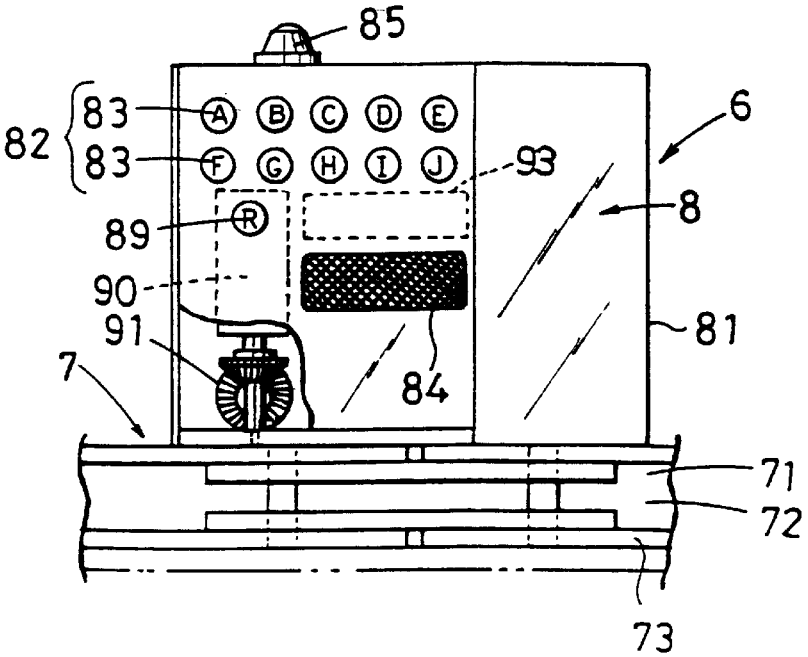
FIG. 3 is a side view of the conveying container of FIG. 2.
Figure 5:
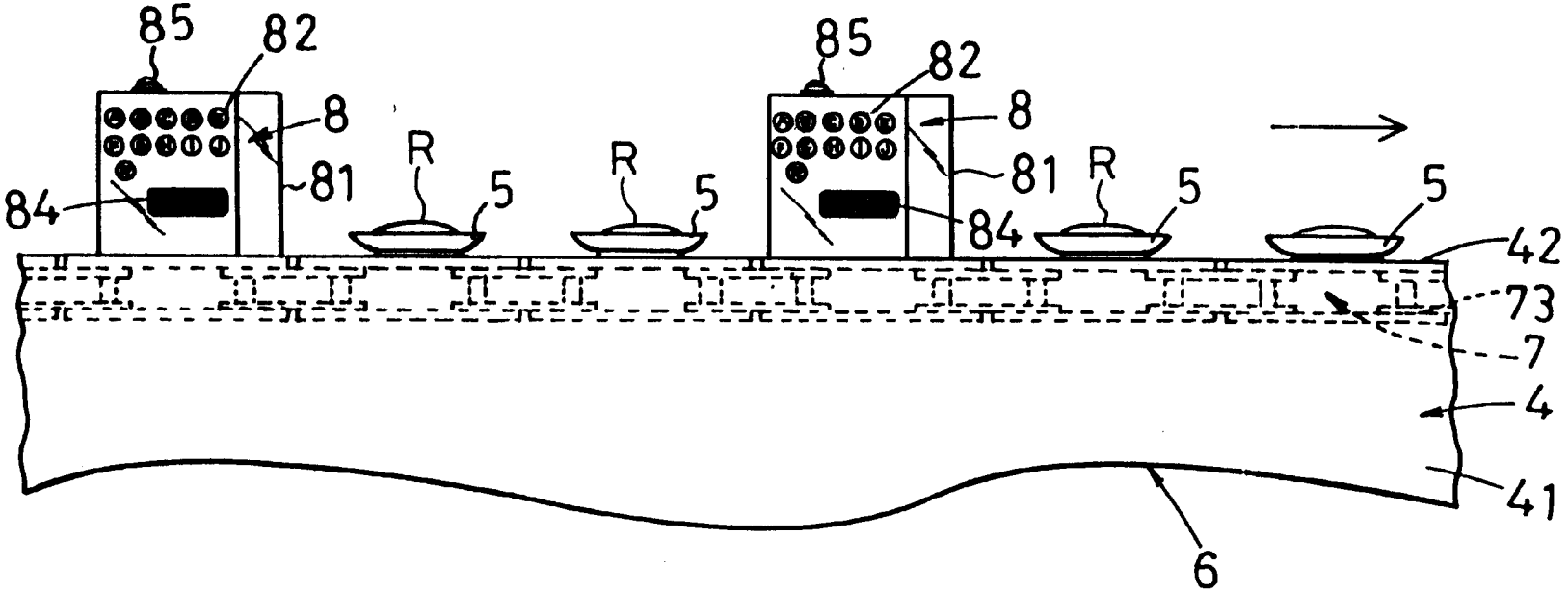
FIG. 5 is a side view of a part of the food and drink conveying system showing the state of conveying containers and plates being placed on the conveying path and conveying.

The conveying path 7 comprises a recess 71 provided in the top wall 42 of the housing portions 4*a*, 4*b* and 4*c*; and a flat endless chain 73 which moves in circulation in the recess 71 by motor drive while it is guided along guide walls 72 provided at both widthwise sides of the recess 71, as shown in FIGS. 2, 3 and 5. As shown in FIG. 5, the plates 5 each putting thereon food or drink are placed directly on the flat chain 73 of the conveying path 7 to convey the plates 5 in circulation.

EMBODIMENT 1

The food and drink conveying system 6 above comprises a conveying container 8 to put thereon an ordered food or drink and be placed on the conveying path 7, and noticing means 84, 85 for giving an orderer a notice of an arrival of his/her order placed on the conveying container 8 at a place near the orderer's table.

Figure 4:
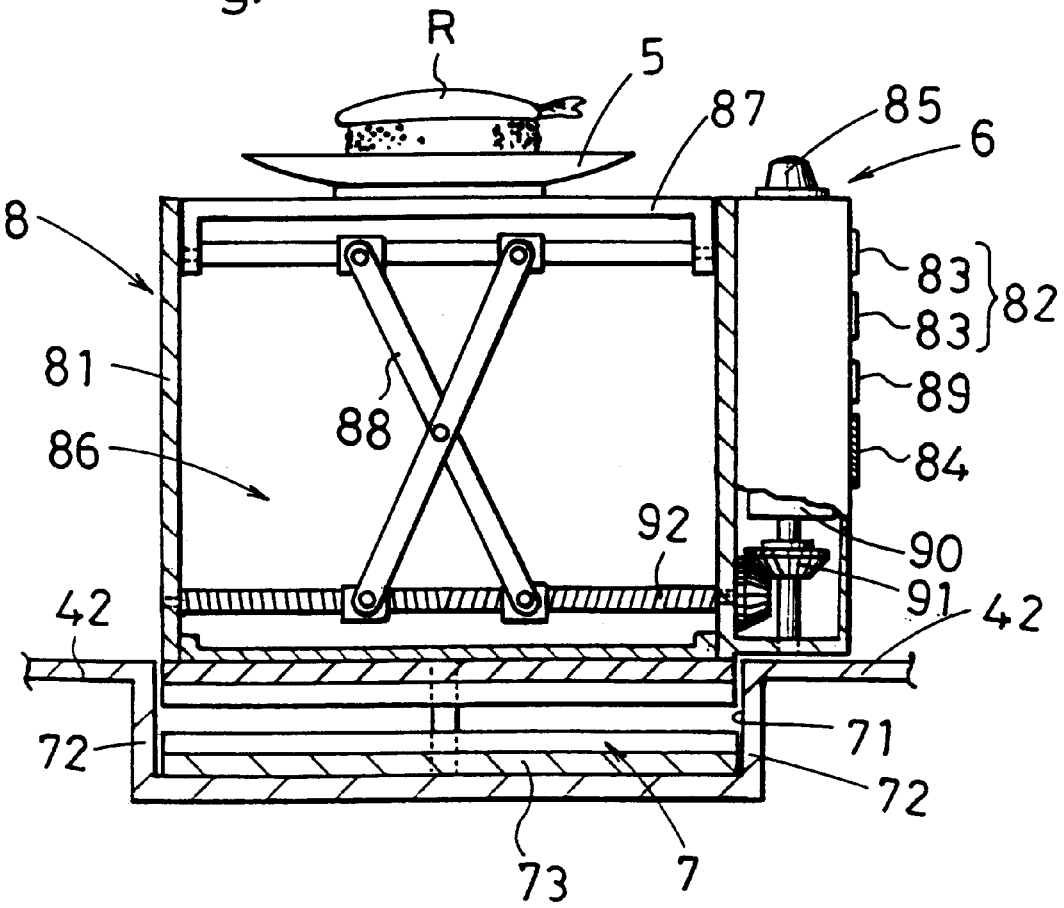
FIG. 4 is a sectional view of the conveying container of FIG. 2, with the plate exposed from the retracting portion.

Specifically, the conveying container 8 includes, as shown in FIGS. 2 to 4, a box-like casing 81 opening at the top and having at a side surface thereof an input portion 82 having press button switches 83 which are marked corresponding to the tables marked with (A), (B), (C), (D), (E), (F), (G), (H), (I) and (J) so that the press button switch 83 having the mark corresponding to the orderer's table can be pressed to input the designated table's mark to the input portion.

The casing 81 is provided with a speaker 84 and a lamp 85 forming the noticing means so that when the order comes near the orderer's table, the arrival of the order can be noticed to the orderer by means of announcement from the speaker 84 and the lightening or flashing of the lamp 85.

The flat chain 73 moves in circulation with a uniform speed and thus the dished-up plates put on the conveying path 7 in the kitchen 3 travel between the kitchen 3 and the respective tables 2 in individual substantially fixed time. In view of this, a timer 93 is used as an operation control means for controlling the operation of the noticing means 84.

Individual time of the timer is preset for each of the tables so that at a point in time when any one of the press button switches 83 of the input portion 82 is pressed, the timer 93 can be put in motion (started) in accordance with the individual preset time.

After the expiration of a preset time interval after the timer 93 is put in motion by the input of the input portion 82, the announcement from the speaker 84 and the lightening of the lamp 85 are started.

Further, the casing 81 is provided in its interior with a retracting portion 86 in which the plate 5 is kept retracted until the notice by means of the speaker 84 and the lamp 85 is started and from which the plate 5 is exposed to be taken out when the notice by means of the speaker 84 and the lamp 85 is started.

The retracting portion 86 is provided with a lift 88 having a table member 87 for placing thereon the plate 5. When the plate 5 is placed on the lift 88 in the kitchen 3, the lift is in its highest level, as shown in FIG. 4. When a reset button switch 89 provided in the casing 81 is pressed to trigger the reset, the plate 5 is completely retracted into the retracting portion 86, as shown in FIG. 2. Then, the timer is put in motion by the input of the input portion 82. At the point in time when the notice by means of the speaker 84 and lamp 85 of the noticing means is started, the lift 88 is raised up to the highest level to project the plate 5 from the retracting portion 86.

The elevating motion of the lift 88 is effected by driving a motor 90 provided at a side of the casing 81 to rotate a driving shaft 92 of the lift 88 via a bevel gear 91 driven in association with the motor 90. The lift 88 is raised by the drive of the motor so that the plate 5 can be exposed just as the notice by means of the speaker 84 and the lamp 89 is started. The lift 88 is lowered by reversing the motor 90 at the push of the reset button switch 89.

With this constructed food and drink conveying system, when a food is ordered from a customer, the ordered food is dished up on the plate 5 in the kitchen 3, and then the plate 5 is placed on the table member 87 of the conveying container 8 and is retracted in the retracting portion 86 at the push of the reset button switch 89.

Then, the press button switch 83 having the mark corresponding to the orderer's table is pressed to input the designated table's mark to the input portion. Then, the conveying container 8 is placed on the flat chain 73 of the conveying path 7, as shown in FIG. 5, to convey it to the dinning area 1, together with other dished-up plates 5 placed directly on the flat chain 73.

In the conveying container 8 placed on the conveying path 7, the preset timer 93 is put in motion at the push of the press button switch 83 and runs out near the orderer's table. Then, the speaker 84 and the lamp 85 are put in motion for announcement and lightening, respectively, and the lift 88 is synchronously raised by the drive of the motor 90 to project the plate 5 from the retracting portion 86. Thus, the orderer can surely aware of his/her order arriving at his/her table even in the middle of eating and drinking and chatting.

Besides, since the order is kept retracted in the retracting portion 86 of the conveying container 8 until it comes near the orderer's table, it can be avoided being taken out at some mid point in the conveying path 7 by another customer.

The noticing means which in illustration above is formed by both the speaker 84 and the lamp 85 for providing the audible and visual notices may be formed by either of them.

Also, the table member 87 may be configured in the form of a doll, for example, so that the order can be presented by using such a doll-like table member.

EMBODIMENT 2

Figure 6:
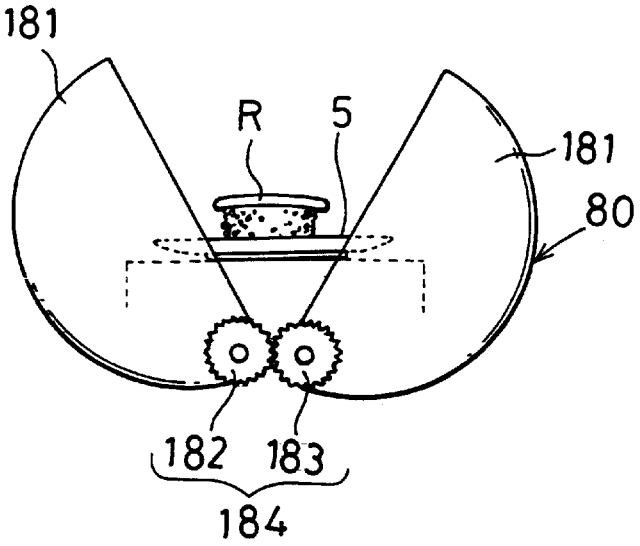
FIG. 6 is a schematic illustration showing another embodiment of the conveying container.

The configuration of the conveying container may be modified such that the plate 5 can be covered with, for example, a spherical open/close cover, as shown in FIG. 6.

Specifically, the conveying container 80 shown in FIG. 6 is provided with a pair of vertically divided, semi-spherical cover members 181 which are arranged with their openings confronting each other and a geared interlocking mechanism 184 which is composed of a pair of gears 182, 183 provided at the bottom of the cover members 181, so that when the timer 93 runs off, the both cover members 181 are opened by the drive of a motor (not shown) associated with one of the gears 182 of the geared interlocking mechanism 184.

With this configured conveying container, since the food or drink on the plate 5 is kept covered with the cover members 181 until it reaches the orderer's table, the order can be conveyed safely as well as be avoided being taken out at some midpoint in the conveying path 7 by another customer.

EMBODIMENT 3

Figure 8:
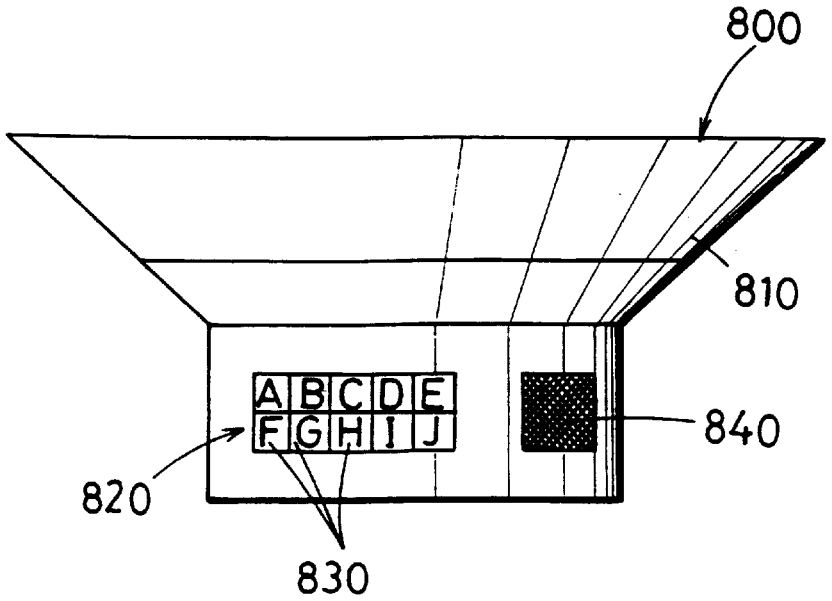
FIG. 8 is a schematic side view of a modified conveying container.
Figure 7:
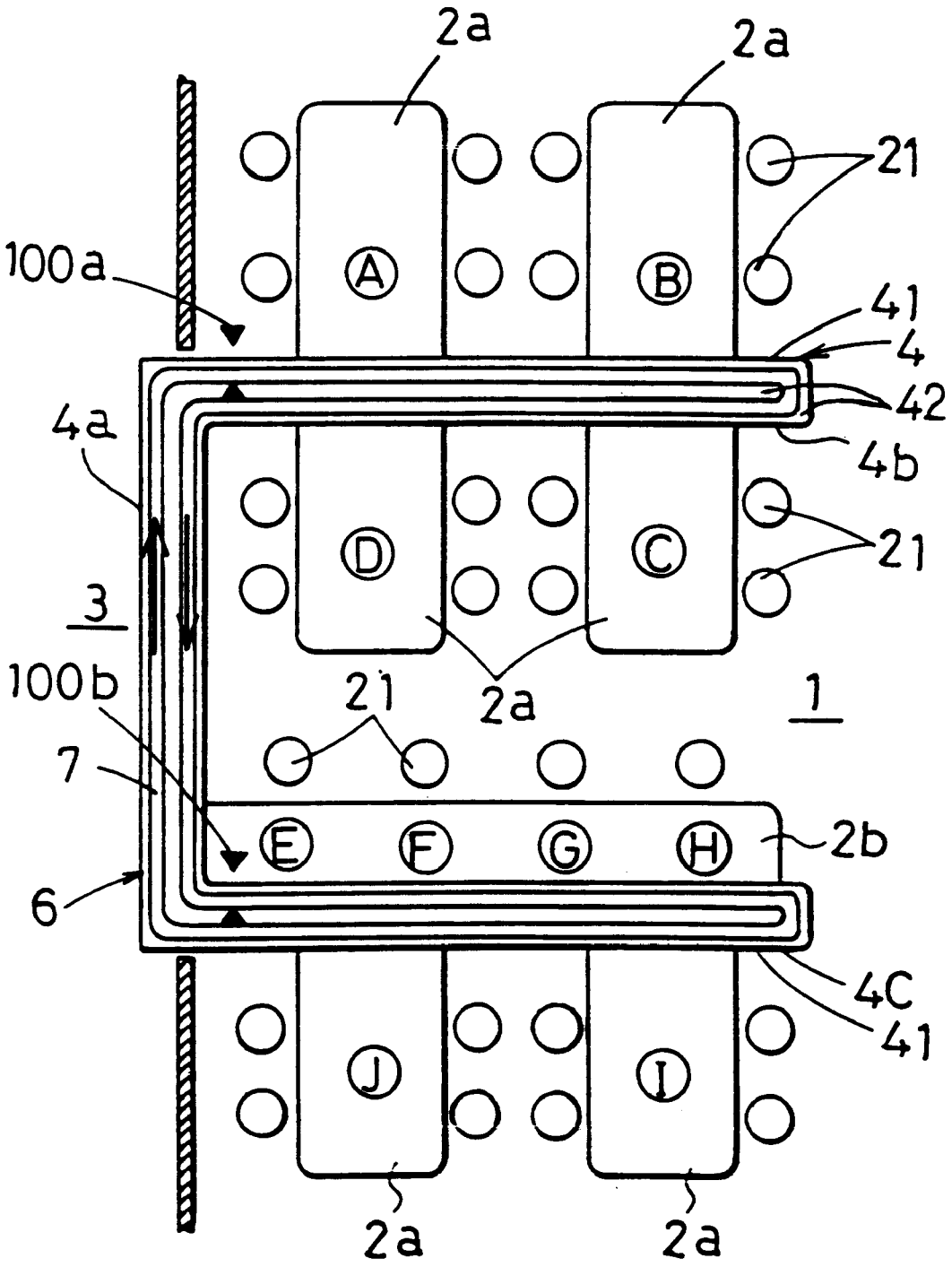
FIG. 7 is a schematic plan view of the interior of the eating house in which a modified food and drink conveying system of the invention is set.
Figure 9:
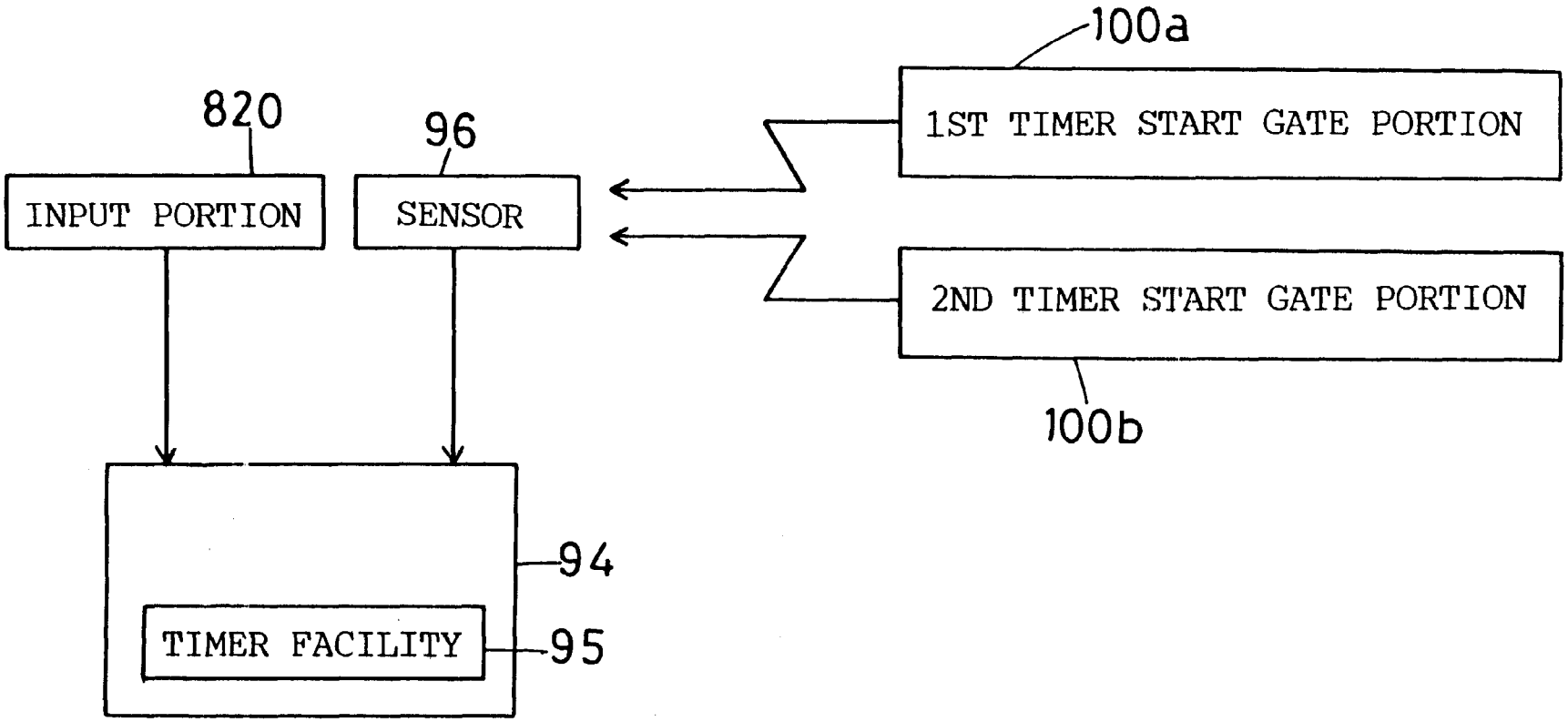
FIG. 9 is a structural drawing of the modified food and drink conveying system.

FIGS. 7 to 9 show a modified embodiment of the present invention. As the basic construction of the food and drink conveying system 6 of this embodiment is identical to that of the embodiment 1, the difference in construction only will be described below.

In the embodiment shown in FIGS. 7 to 9, a microcomputer 94 is used as the operation control means, and a timer facility 95 in which individual traveling time for a conveying container 800 to travel to the respective tables is preset is constructed on a program of the microcomputer 94. Also, a sensor 96 for detecting infrared radiation of timer start gate portions 100*a*, 100*b* discussed later is connected to an input portion of the microcomputer 94. At a point in time when the sensor 96 detects infrared radiation of the timer start gate portions 100*a*, 100*b*, the timer preset corresponding to the traveling time for the conveying container to travel to the table having the mark input to the input portion 820 is started.

The timer start gate portions 100*a*, 100*b* for starting the timer of the timer facility 95 are provided at the conveying path 7. In the illustrated embodiment, the first and second timer start gate portions 100*a*, 100*b* are set at entrance sides of the conveying path 7 in the second and third housing portions 4*b* and 4*c* so that they can apply infrared rays in such a manner as to intersect the conveying path 7.

In the timer facility 95 is preset the individual traveling time required for the conveying container 800 to travel to the individual tables. For the tables marked with (A), (B), (C) and (D), the individual traveling time is preset for the conveying container 800 to travel between the first timer start gate 100*a* and individual places before these individual tables. For the tables marked with (E), (F), (G) (H), (I) and (J), the individual traveling time is preset for the conveying container 800 to travel between the second timer start gate 100*b* and individual places before these individual tables.

The timer start gate portions 100*a*, 100*b* may use an electric wave, a magnetic field, or a photoelectric discharge tube, in addition to the infrared radiation.

The conveying container 800 includes a dish-like casing 810 opening at the top and assembling in a lower portion thereof the microcomputer 94, a battery (not shown) of a source of electrical energy of the microcomputer 94, etc. The casing 810 has at a lower side thereof an input portion 820 having press button switches 830 which are marked corresponding to the tables 2 marked with (A), (B), (C), (D), (E), (F), (G), (H), (I) and (J) so that the press button switch 830 having the mark corresponding to the orderer's table can be pressed to input the designated table's mark to the input portion.

The casing 810 is provided at a lower side thereof with a speaker 840 of the noticing means, so that when the order comes near the orderer's table, the arrival of the order is announced by means of the speaker 840.

With this constructed food and drink conveying system, the food e.g. sushi ordered is dished up on the plate 5 in the kitchen 3 and then the plate is placed in the conveying container 800. After the press button switch 830 having the mark corresponding to the orderer's table is pressed to input the designated table mark to the input portion, the conveying container 800 is placed on the flat chain 73 of the conveying path 7 to convey it to the dinning area 1.

When the orderer 's table is any one of the tables marked with (A), (B), (C) and (D), the conveying container 800 is placed on the conveying path 7 at a position upstream from the first timer start gate portion 100*a*. On the other hand, when the orderer 's table is any one of the tables marked with (E), (F), (G) (H), (I) and (J), the conveying container 800 is placed on the conveying path 7 at a position upstream from the second timer start gate portion 100*b*.

In the conveying container 800 placed on the conveying path 7, the timer 93 starts at a point in time when the conveying container 800 passes the timer start gate portion 100*a* or 100*b* and runs out near the orderer's table, and then the speaker 840 is put in motion for announcement under control of the microcomputer 94. Thus, the orderer can surely aware of his/her order arriving at his/her table even in the middle of eating and drinking and chatting.

According to this embodiment, since the timer 93 starts at a point in time when the conveying container passes the timer start gate portion 100*a* or 100*b*, the order can surely be announced by means of the speaker 840 at a place near the orderer's table, irrespective of variations in, for example, location of the conveying container 800 placed on the conveying path 7 or timing of the push of the button switches 830. Thus, the order can be announced just at the right time to always let the orderer know his/her order with accuracy.

In this embodiment also, a conveying container having a similar structure to those capable of retracting therein the food and drink as shown in FIGS. 2 and 6 may be used as a substitute for the conveying container 800.

Additionally, the respective tables and the counter 2*a* and 2*b* are provided with transmitters for the individual marked or numbered tables, while on the other hand, the conveying container 8, 80 or 800 is provided with a counting means for receiving information transmitted from the transmitters to count the table numbers, so that when the counting means counts the immediately preceding number of the table numbers input to the input portion 82 or 820, the noticing means can be put in motion.

Also, the speaker 84 or 840 and the lamp 85 forming the noticing means which in illustration are arranged in the conveying container may be arranged on the table side.

EMBODIMENT 4

Further, FIGS. 10 to 13 show a further modified embodiment of the present invention. As the basic construction of the food and drink conveying system 6 of this embodiment is identical to that of the embodiment 3, the difference in construction only will be described below.

In the embodiment shown in FIGS. 10 to 13, a shorting mechanism 700 for bridging parts of the conveying path 7 is arranged in some midpoint of the conveying path 7 in the second housing portion 4*b*.

The shorting mechanism 700 is basically composed of a short conveying path 701 and a pair of first and second guiding members 702 and 703.

Figure 10:
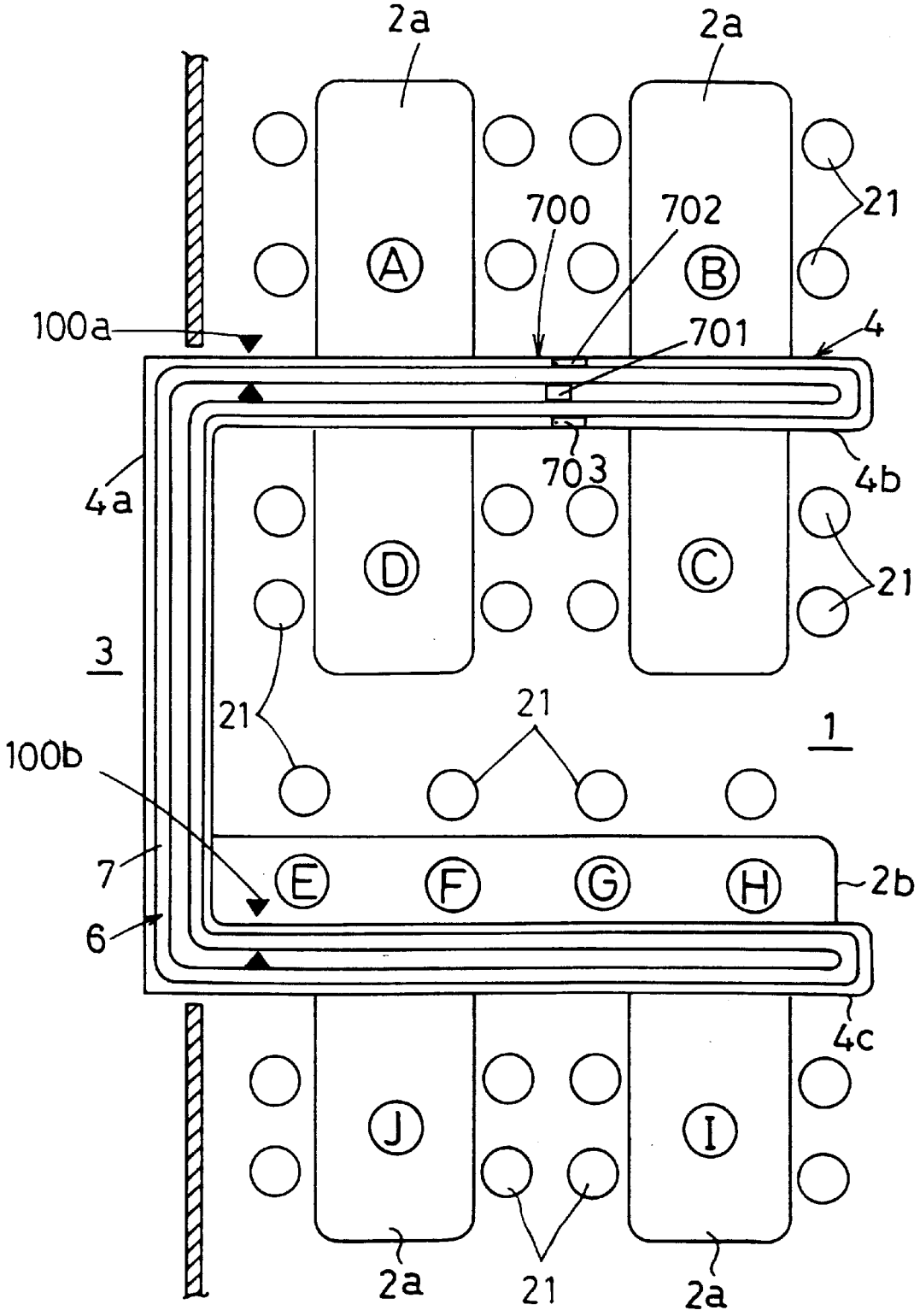
FIG. 10 is a schematic plan view of the interior of the eating housing in which a further modified food and drink conveying system of the invention is set.
Figure 11:
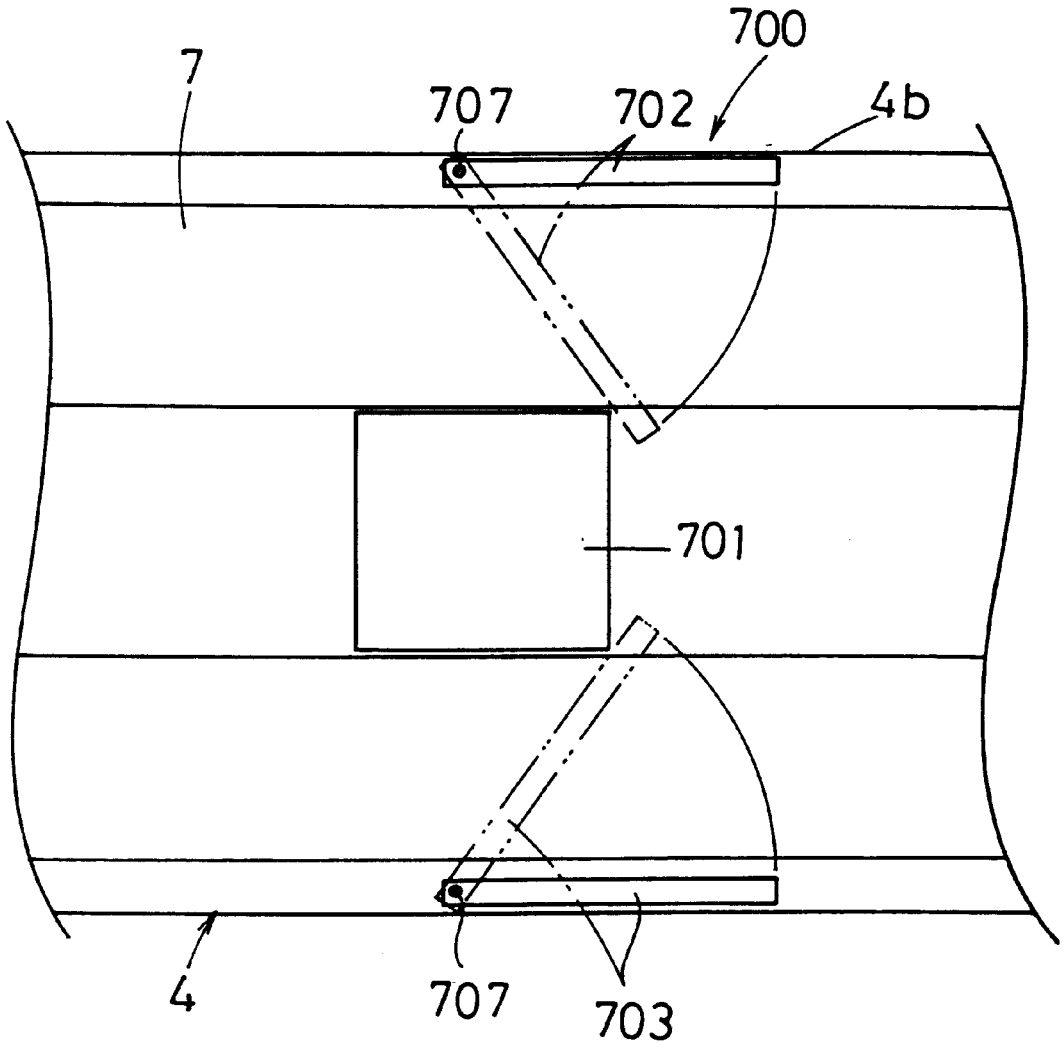
FIG. 11 is an enlarged plan view of a principal part of the food and drink conveying system of FIG. 10.
Figure 12:
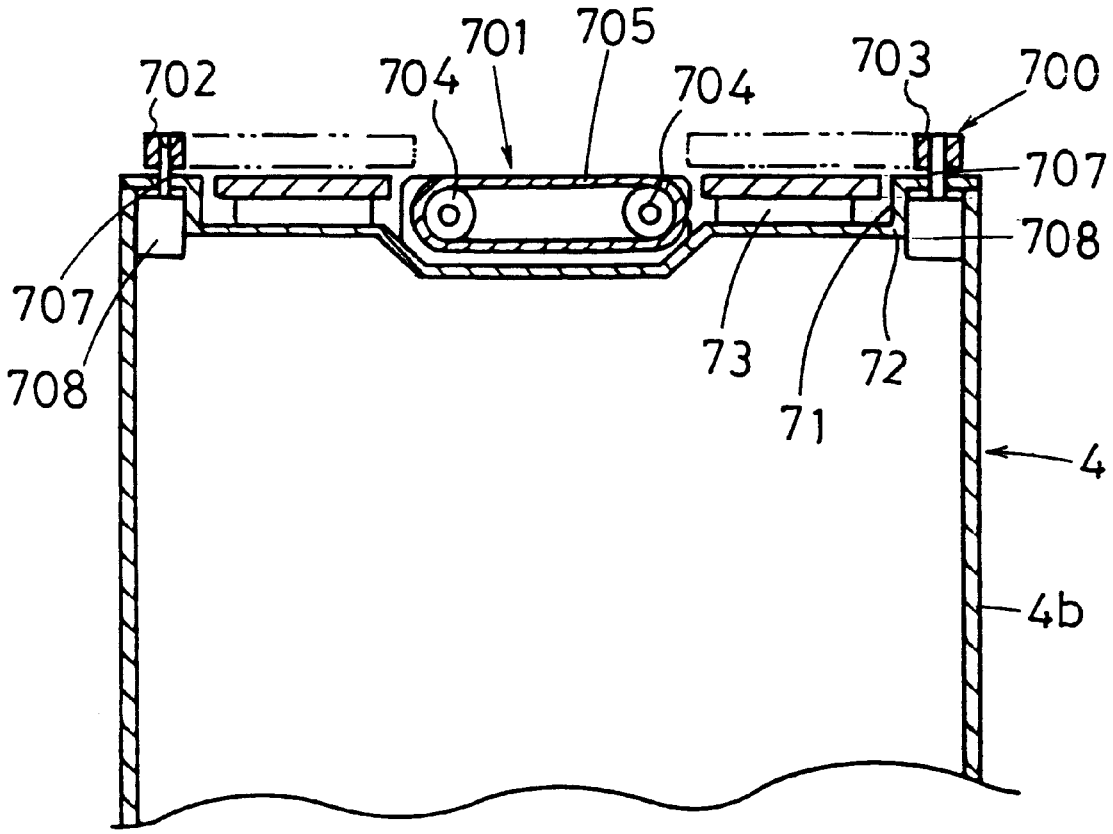
FIG. 12 is an enlarged sectional view of the same.
Figure 13:
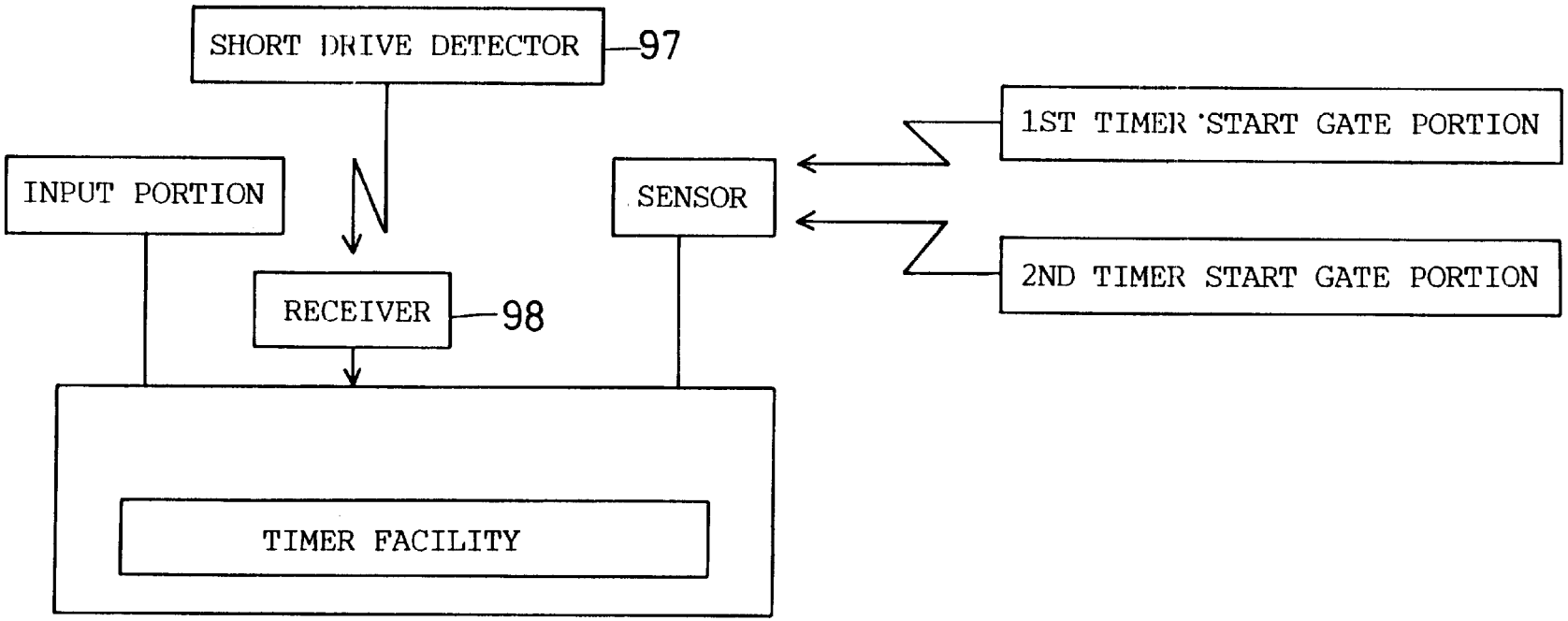
FIG. 13 is a structural drawing of the embodiment of the food and drink conveying system shown in FIG. 10.

The short conveying path 701 is arranged in some midpoint of the second housing portion 4*b*, as schematically shown in FIG. 10, so that the conveyance of the food and drink to the tables marked with (13) and (C) arranged in the second housing portion 4*b* can be brought to rest. The shot conveying path 701 is provided with a pair of rollers 704, a conveying belt 705 spreading between the rollers 704 in endless relation, and a motor (not shown) as a drive for rotating one of the rollers 704.

A first guide member 702 is provided at an inlet side of the short conveying path 701, for letting the plate 5 conveyed by the conveying path 7 transfer to the short conveying path 701. A second guide member 703 is provided at an outlet side of the short conveying path 701, for letting the plate 5 conveyed by the short conveying path 701 transfer to the conveying path 7. The first and second guide members 702, 703 are swingably pivoted to pivot shafts 707, respectively, and the pivot shafts 707 are associated with the drive 708 of the motor at lower portions thereof so that the guide members 702, 703 can automatically be swung about the pivot shafts 707 in a substantially horizontal direction to intersect to the conveying path 7.

The shorting mechanism 700 is provided with a short drive detector 97 for detecting the switching to the short drive caused by the first guide member 702 being swung to such a position as to intersect to the conveying path 7.

The timer facility 95 in which individual traveling time for the conveying container 800 to travel to the respective tables is preset is constructed on a program of the microcomputer 94 forming the operation control means. To the input portion of the microcomputer 94 is connected a receiver 98 for receiving detected signals from the short drive detector 97 detecting the switching to the short drive caused by the first guide member 702 being swung to such a position as to intersect to the conveying path 7.

In the timer facility 95 is preset the individual traveling time required for the conveying container 800 to travel to the individual tables. For the tables marked with (A), (B), (C) and (D), the individual traveling time is preset for the conveying container 800 to travel between the first timer start gate 100*a* and individual places before these individual tables. For the table (D) in particular, two possible traveling time is preset for the conveying container to reach the table without and with passing through the short conveying path 701 of the shorting mechanism 700.

For the tables marked with (E), (F), (G) (H), (I) and (J), the individual traveling time is preset for the conveying container 800 to travel between the second timer start gate 100*b* and individual places before these tables, as in the case of the embodiment above.

With this constructed food and drink conveying system, the food e.g. sushi ordered is dished up on the plate 5 in the kitchen 3 and then the plate 5 is placed in the conveying container 800. After the press button switch 830 having the mark corresponding to the orderer's table is pressed to input the designated table mark to the input portion, the conveying container 800 is placed on the flat chain 73 of the conveying path 7 to convey it to the dinning area 1.

By the way, the so-called short drive mode, in which the short conveying path 701 of the shorting mechanism 700 is driven to bridge parts of the conveying path 7 with the both guide members 702, 703, so as not to convey any food and drink to the tables marked with (B) and (C), is detected by the short drive detector 97. When the order is received from the table (D) in this short drive mode, the food e.g. sushi ordered is dished up on the plate 5 and then the plate 5 is placed in the conveying container 800. After the press button switch 830 having the mark corresponding to the orderer's table is pressed, the conveying container 800 is placed on the flat chain 73 of the conveying path 7 to convey it to the dinning area 1.

Then, at a point in time when the conveying container 800 placed on the conveying path 7 passes the timer start gate portion 100*a*, the timer of the timer facility 95 starts, selecting the traveling time required for the conveying container to reach the table (D) with passing through the short conveying path 701 of the shorting mechanism 700. Accordingly, even when the short drive is in operation, the preset timer 93 runs out near the orderer's table (D) with accuracy and the speaker 840 is then put in motion for announcement under the control of the microcomputer 94.

In this embodiment also, a conveying container having a similar structure to those capable of retracting therein the food and drink as shown in FIGS. 2 and 6 may be used as a substitute for the conveying container 800.

Also, the speaker 84 or 840 and the lamp 85 forming the noticing means which in illustration are arranged in the conveying container may be arranged on the table side.

What is claimed is:

1. A food and drink conveying system comprising:

a conveying path for circulating food and drink;

a plurality of stations each having an identification, and being arranged along the conveying path;

a conveying container which contains the food or the drink and which is placed on the conveying path; and noticing means for providing an orderer at one of the plurality of stations notice of an arrival of his/her food or drink, wherein the conveying container includes an input portion in which an identification of one of the plurality of stations is input, and operation control means for controlling operation of the noticing means by an input to the input portion and enabling only the orderer at the one of the plurality of stations to remove the food or drink from the conveying path.

2. A food and drink conveying system according to claim 1, wherein the conveying container includes a retracting portion in which the food or the drink is kept retracted until notice by the noticing means is started and from which the food or the drink is exposed so as to be taken out when the notice is provided by the noticing means.

3. A food and drink conveying system according to claim 1, wherein the operation control means includes a timer in which travelling time for the conveying container to travel to the individual stations is preset and wherein the conveying path is provided with a timer start gate portion for starting operation of the timer.

4. A food and drink conveying system according to claim 2, wherein the operation control means includes a timer in which travelling time for the conveying container to travel to the individual stations is preset and wherein the conveying path is provided with a timer start gate portion for starting operation of the timer.

5. A food and drink conveying system comprising:

a conveying path for circulating food and drink;

a plurality of stations arranged along the conveying path;

a conveying container which contains the food or the drink and which is placed on the conveying path; and noticing means for providing an orderer notice of an arrival of his/her food or drink, wherein the conveying container includes a retracting portion in which the food or the drink is kept retracted until notice by the noticing means is provided and from which the food or the drink is exposed so as to be removed by said orderer.

6. A food and drink conveying system according to claim 5, wherein the operation control means includes a timer in which travelling time for the conveying container to travel to the individual stations is preset and wherein the conveying path is provided with a timer start gate portion for starting operation of the timer.

* * * * *